United States Patent [19]

Nieman

[11] Patent Number: 4,516,821

[45] Date of Patent: May 14, 1985

[54] ELECTRICAL CONNECTOR LOCKING MECHANISM

[75] Inventor: Gerald R. Nieman, Glendale, Ariz.

[73] Assignee: International Telephone & Telegraph Corporation, New York, N.Y.

[21] Appl. No.: 393,094

[22] Filed: Jun. 28, 1982

[51] Int. Cl.[3] ..... H01R 13/62

[52] U.S. Cl. ..... 339/75 M; 339/91 R; 339/94 M

[58] Field of Search ..... 339/89 R, 89 M, 90 R, 339/91 R, 94 M, 75 M, 45 M

[56] References Cited

U.S. PATENT DOCUMENTS

| | | | |
|---|---|---|---|
| 1,468,732 | 9/1923 | Bradbury . | |
| 2,377,812 | 6/1945 | Scheiwer | 285/169 |
| 2,441,363 | 5/1948 | Krueger | 285/174 |
| 2,775,745 | 12/1956 | Eaton | 339/91 |
| 2,983,893 | 5/1961 | Jackson | 339/91 |
| 3,104,088 | 9/1963 | Cator | 251/149.6 |
| 3,156,512 | 11/1964 | Peterson et al. | 339/45 M |
| 3,156,513 | 11/1964 | Peterson et al. | 339/45 M |
| 3,165,340 | 1/1965 | Kuehl et al. | 285/316 |
| 3,193,309 | 7/1965 | Morris | 285/27 |
| 3,336,562 | 8/1967 | McCormick et al. | 339/45 |
| 3,452,316 | 6/1969 | Panek et al. | 339/45 |
| 3,497,862 | 2/1970 | Geffner | 339/45 |
| 3,509,515 | 4/1970 | Acord | 339/45 |
| 3,550,065 | 12/1970 | Phillips | 339/94 M |
| 3,594,694 | 7/1971 | Clark | 339/91 R X |
| 3,678,439 | 7/1972 | Vetter | 339/46 |
| 3,745,514 | 7/1973 | Brishka | 339/91 R |
| 3,793,610 | 2/1974 | Brishka | 339/91 R X |
| 3,808,579 | 4/1974 | Mina et al. | 339/46 |
| 3,848,950 | 11/1974 | McCormick et al. | 339/90 R |
| 3,953,098 | 4/1976 | Avery et al. | 339/45 |
| 4,017,139 | 4/1977 | Nelson | 339/91 R |
| 4,056,298 | 11/1977 | Cooper et al. | 339/90 |
| 4,066,315 | 1/1978 | Arneson | 339/89 |
| 4,074,927 | 2/1978 | Ball | 339/89 |
| 4,138,181 | 2/1979 | Hacker et al. | 339/45 R |
| 4,154,496 | 5/1979 | Gallagher | 399/89 R |
| 4,183,605 | 1/1980 | Arneson | 339/89 M |
| 4,291,931 | 9/1981 | Stupay | 339/45 R |

*Primary Examiner*—Z. R. Bilinsky

*Attorney, Agent, or Firm*—T. E. Kristofferson; T. L. Peterson

[57] ABSTRACT

A releasable locking mechanism is provided for an electrical connector in which a plug connector member embodies a sleeve that carries a locking ring. The ring is adapted to engage with a groove in the mating receptacle connector member. A plurality of lock pins are slidably movable over the ring to retain it in its locked position in the groove. In a preferred embodiment, the lock pins embody heads which extend through slots in the sleeve surrounding the pins. The lock pins are actuated by a coupling ring surrounding the rear portion of the sleeve.

21 Claims, 9 Drawing Figures

ELECTRICAL CONNECTOR LOCKING MECHANISM

BACKGROUND OF THE INVENTION

The present invention relates generally to an electrical connector and, more particularly, to a locking mechanism for an electrical connector.

Some electrical connectors embody self-locking mechanisms contained in or attached to the connector shells to provide an interlock between the connector halves and to maintain the connector in the mated condition. Two features which are often required in special applications of self-locking connectors are those of a positive quick release and a low force to cause the release of the mechanism.

Although many self-locking connectors are available which have satisfied the above requirements, further limitations of the selection of connectors are frequently imposed. Typical of these limitations are envelope size for either one or both of the mating halves of the connector, cost effectiveness of the actuating mechanism, and weight of one or the other of the connector halves.

A connector embodying a quick release locking mechanism which is simple, strong, cost effective and offers multiple release modes is disclosed in U.S. Pat. No. 3,843,853 to Panek et al., assigned to the assignee of the present application. This patent discloses a self-locking mechanism which has been referred to as a "ring lock." In this connector, matching grooves are formed in the outer surface of the plug shell and the inner surface of the receptacle shell. The grooves are aligned when the shells are fully mated. The groove in the plug shell is deeper than the groove in the receptacle shell. A split ring is mounted in the grooves. In its normal unstressed condition the ring is lodged in both the grooves thereby interlocking the shells of the mating plug and receptacle halves of the connector. The locking ring is retained in its locking position by a radially extending pin disposed between the free ends of the split ring. When the pin is removed the split ring is free to be contracted upon application of an axially directed unmating force to the mating connector members.

While the Panek et al. connector locking mechanism is entirely adequate for many applications, the locking arrangement embodies several features which will impose limitations on the use of the connector for certain applications. For example, the connector half carrying the split lock ring is thick by nature of design requirements and therefore adds to the weight of that half of the connector. Also, the ring must be mounted on an external diameter and must be allowed to contract radially inwardly. Further, the location of the gap in the split lock ring must be properly oriented to assure proper engagement of the lock pin therein. Although the ring gap location problem can be solved in a variety of ways, the problem of weight addition to the ring-carrying connector half, and the necessity to carry the ring on an external diameter pose more difficult problems.

It is the object of the present invention to provide a novel ring lock type of locking connector which provides an option to select the connector half on which the lock ring is mounted, and to select which shell overlaps the other so as to optimally provide the connector functions such as sealing or alignment. Another object of the invention is to provide a ring lock type of connector locking mechanism which does not require the exact positioning of the ring end gap, which is required by the Panek et al. connector.

Other prior art coupling mechanisms which might be considered relevant to the present invention are disclosed in U.S. Pat. Nos. 2,939,729 to O'Shaughnessy, 3,793,610 to Brishka and 3,980,373 to McCormick et al. Brishka discloses a split locking ring for a coaxial electrical connector while O'Shaughnessy discloses a quick disconnect coupling for hoses or pipes in which a plurality of arcuate locking segments, which are biased inwardly by a surrounding coil spring, are forced outwardly into a locking groove by a locking ring. McCormick et al. discloses both breech lock and tang lock mechanisms for an electrical connector having coupling ring actuating devices somewhat similar to that utilized in the present invention.

SUMMARY OF THE INVENTION

According to a principal aspect of the present invention, there is provided an electrical connector member which is adapted to mate with a second connector member having a shell formed with a circular locking groove. The connector member comprises a housing having an insulator therein containing a plurality of electrical contacts. A sleeve extends forwardly from the housing which is adapted to telescopically engage with the shell of the second connector member. A resilient lock ring is carried by the sleeve, and may be located either on the inside or outside of the sleeve depending upon the design choice of the manufacturer and the connector sealing and alignment functions which are required. Preferably, in its unstressed condition, the lock ring has one periphery spaced from a surface of the sleeve providing a gap therebetween and the other periphery dimensioned to fit into the locking groove in locking engagement therewith. The ring is capable of deflecting radially toward the sleeve surface when the connector member is engaged with or disengaged from the second connector member. A plurality of axially movable lock pins are slidable into said gap for locking the ring in the locking groove when the connecting members are mated. Means is provided for axially shifting the lock pins between a forward locking position in the gap and a rear release position behind the ring.

Thus, by the present invention it is possible to locate the lock ring inside a sleeve which provides greater freedom in connector design functions such as sealing or alignment. However, by the present invention it is possible to carry the lock ring on an external diameter if such is desired. In any event, the ring lock arrangement of the present invention does not require the exact positioning of a ring end gap as in the Panek et al. patent.

DESCRIPTION OF THE PREFERRED EMBODIMENTS

Figure 1:
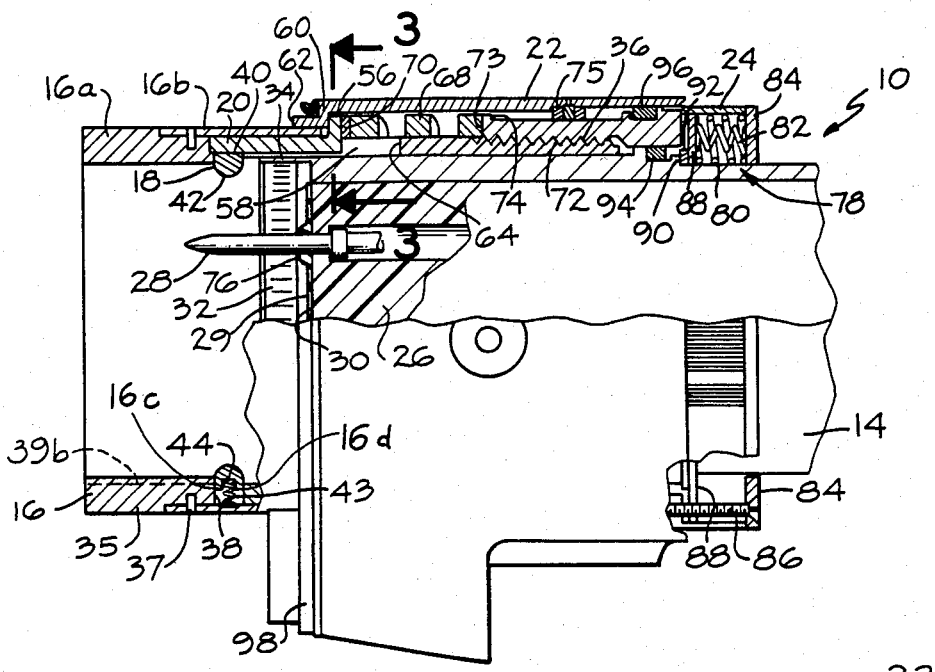
FIG. 1 is a partial longitudinal sectional view taken along line 1—1 of FIG. 2 showing the preferred embodiment of the plug connector member of the present invention wherein the lock ring is mounted on an internal diameter, and the parts of the locking mechanism are illustrated in the position that they would assume if the plug connector member were mated with a receptacle connector member.
Figure 3:
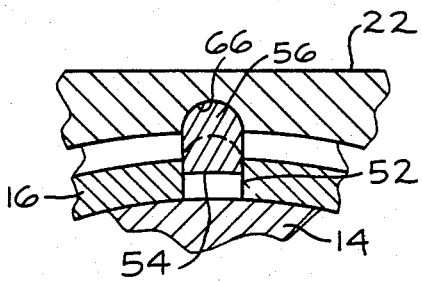
FIG. 3 is a fragmentary sectional view taken along line 3—3 of FIG. 1 showing the interrelationship between a lock pin, the lock sleeve and the outer housing of the plug connector member.

Referring now to the drawings in detail, wherein the same reference numerals are utilized throughout the various views to indicate like or corresponding parts, the preferred embodiment of the connector of the present invention is illustrated in FIGS. 1 to 8. The plug connector member, generally designated 10, is adapted to mate with a receptacle connector member (see FIGS. 4 to 8), generally designated 12. The plug consists of four major component assemblies, namely, an insulator barrel 14 which contains a pin insulator assembly, a lock sleeve 16 which contains the lock ring 18 and a plurality of lock pins 20, an outer housing 22 and a coupling ring 24 which engages the lock mechanism and causes engagement of the plug contacts with the contacts in the receptacle connector member.

The barrel 14 contains an insulator 26 in which there are mounted a plurality of pin contacts 28. The pin contacts extend forwardly of an interfacial seal 29 on the front face 30 of the insulator. An EMI/EMP grounding spring 32 is mounted on a forwardly extending lip 34 on the barrel 14 as can be best seen in FIG. 4.

The lock sleeve 16 has a generally cylindrical configuration, with the forward portion 35 of the sleeve extending forwardly from the barrel 14, and the rear portion 36 of the sleeve surrounding the barrel. The rear of the lock sleeve is keyed to the barrel 14 by keys and keyways, not shown, which allows the barrel to slide axially within the sleeve but prevents it from rotating within the sleeve thereby maintaining proper polarization for contact engagement. As seen in FIG. 1, the lock sleeve is formed of two telescoping parts 16*a* and 16*b* secured together by pins 37. The parts are formed with spaced annular shoulders 16*c* and 16*d* providing an annular groove 38 in the inner surface of the lock sleeve. The front part 16*a* of the sleeve is formed with three polarizing keyways 39*a*, 39*b* and 39*c* (see FIG. 2) in its inner surface which slidably receive matching keys, not shown, on the receptacle connector member 12.

The lock ring 18 is a split resilient metal ring which is mounted in an annular groove 38 formed in the inner surface of the sleeve 16. The groove is rectangular in cross-section. The lock ring is generally "D" shaped in cross-section, providing a cylindrical outer periphery 40 and a rounded inner periphery 42. The ring is maintained in concentric relationship with respect to the axis of the lock sleeve by three coil springs 43 equispaced around the circumference of the ring. The coil springs 43 are preferably mounted in small pockets 44 and 44*a*, respectively, formed in the outer periphery of the lock ring and the bottom of the groove 38.

Figure 2:
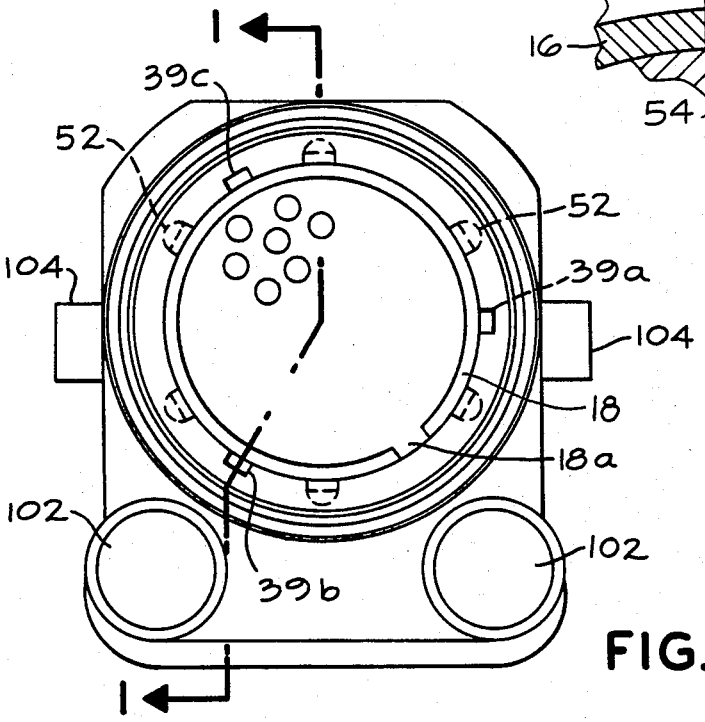
FIG. 2 is a front end view of a plug connector member illustrated in FIG. 1.

The depth of the groove 38 is at least as great as the radial thickness of the lock ring so that the ring may be expanded to lie entirely within the groove. In its unstressed condition, the ring has its outer periphery 40 spaced from the bottom of the groove 38. The inner diameter of the ring is equal to the diameter of the bottom of a circular locking groove 45 formed in the inner shell 46 of the receptacle connector member 12. The outer diameter of the ring is selected so that the ring will remain trapped in the groove 38. The ring is cut radially to provide a gap 18*a*, as seen in FIG. 2, which is sufficiently long so that the ring may be compressed while it is being installed through the forward end of sleeve 16 into the groove 38.

Figure 5:
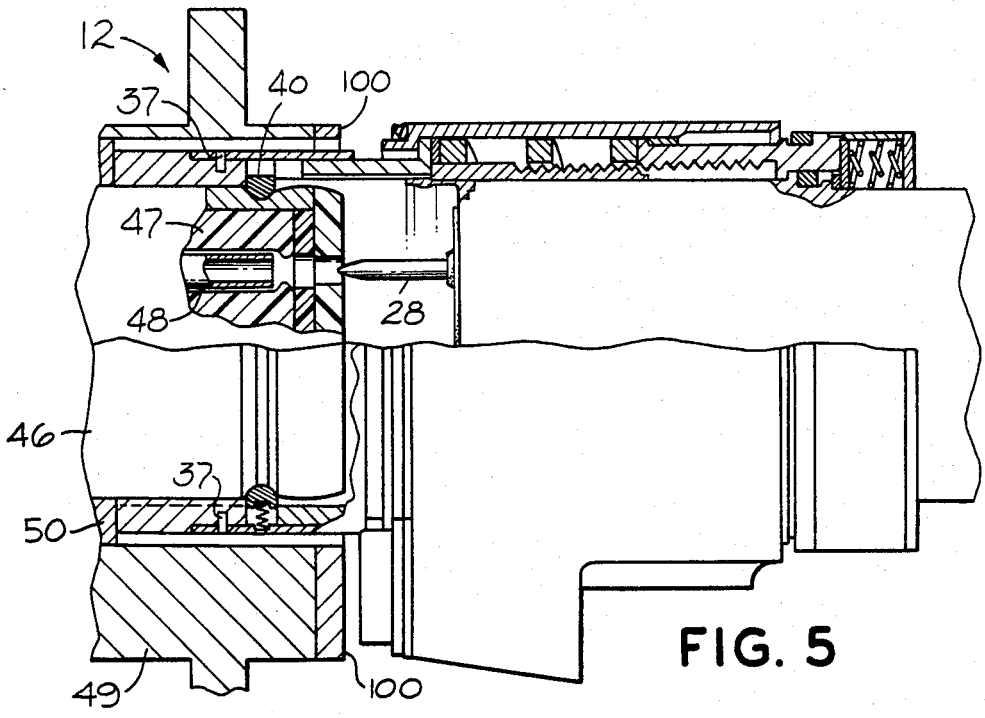
FIG. 5 is a partial longitudinal sectional view similar to FIG. 4 showing the plug connector member initially engaged with the receptacle member, but before the contacts in the connector members engage each other.

The receptacle inner shell 46 surrounds an insulator 47 containing socket contacts 48 positioned to mate with the plug pin contacts 28. An outer shell 49 surrounds the shell 46. As seen in FIG. 5, an insulation filler ring 50 is positioned between the two shells. The forward portion of the inner shell 46 is rounded as indicated at 51. Thus when the lock sleeve is telescopically fitted over the shell, the lock ring 18 will expand by the camming action between the rounded inner periphery 42 of the ring and the rounded forward portion 51 of the shell, forcing the ring outwardly in the groove 38 in the lock sleeve. Further forward movement of the lock sleeve over the receptacle shell will result in the ring 18 contracting into the groove 45 locking the plug and receptacle members together. However, in this condition, the lock ring would still be free to expand.

According to the invention, there is provided a plurality of lock pins 20 which form obstructions which are placed between the outer periphery of the lock ring and the bottom of the groove 38 which will lock the ring 18 in the locking groove 45 of the receptacle shell 46.

The lock pins 20 are slidably mounted in axially extending grooves 52 formed in the inner surface of the lock sleeve 16. The axially extending grooves 52 intersect the annular groove 38 which carries the lock ring. The inner surface 54 of each lock pin is contoured to conform to the cylindrical outer periphery 40 of the lock ring thereby distributing the lock bearing load over a wide surface of the lock ring at each pin location.

Each lock pin embodies a rear radially extending head portion 56 which extends outwardly through an axially extending slot 58 between the forward portion 35 and the smaller diameter rear portion 36 of the lock sleeve. The forward end of the outer housing 22 is formed with an inwardly extending flange 60 having a forward cylindrical lip 62 thereon extending over the forward portion of the lock sleeve. The head portions of the lock pins fit in slots 66 in flange 60 so that forward movement of the lock pins is restricted by the flange. Rearward movement of the lock pins relative to the sleeve 16 is limited by the rear portions 64 of the slots 58 in the sleeve.

The head portions 56 of the lock pins fit into curved recesses 66 (see FIG. 3) formed in the rear surface of the outer housing flange 60. The head portions of the pins are trapped in the recesses by the spring load of a coil spring 68 surrounding the rear portion 36 of the lock sleeve. This arrangement provides positive positioning of the lock pins with regards to the lock ring, yields simplicity in construction and assembly, and provides a keying arrangement between the lock sleeve and the outer housing 22. The spring 68 acts upon the head portions of the lock pins through a thrust ring 70.

The forward portion of the coupling ring 24 is threaded to the rear portion 36 of the lock sleeve as indicated at 72. The coil spring 68 in the space between the lock sleeve and the housing 22 is disposed between the thrust ring 70 and the forward end 73 of the coupling ring 24. Rearward movement of the coupling ring relative to the housing is limited by engagement of a forward outwardly extending flange 74 on the coupling ring engaging a retaining ring 75 fixed to the inside of the housing.

An interfacial seal spring assembly 78 is provided at the rear of the coupling ring 24. The assembly includes a plurality of different spring rate coil springs 80 and 82 which are disposed between a rear retainer plate 84 fixed to the coupling nut 24 by screws 86, and a thrust plate 88 which bears against a rearwardly facing annular shoulder 90 on the barrel 14 through an anti-friction washer 92. The seal spring assembly 78 provides a resilient compressive force between the plug barrel and receptacle shell, when the plug and receptacle members are mated, assuring compression of the interfacial seals 76.

An annular seal 94 is provided between the outer surface of the barrel and the interior of the coupling ring 24, and another annular seal 96 is provided between the outer surface of the coupling ring and the interior of the outer housing 22. An annular housing face seal 98 is provided on the front of the flange 60 of the housing 22.

Figure 4:
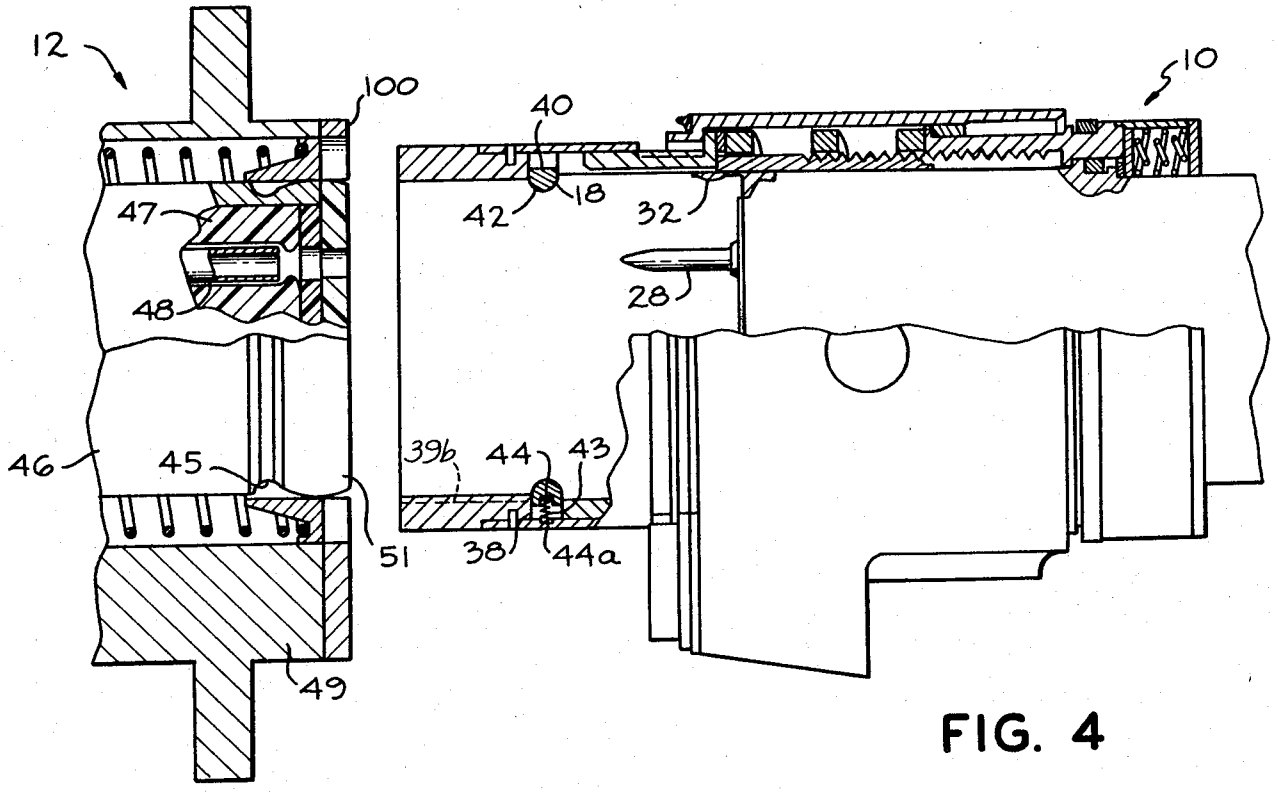
FIG. 4 is a partial longitudinal sectional view through the plug connector member of the present invention and the front end of the mating receptacle member, with the coupling ring of the plug connector member actuated to ready the locking mechanism for engagement with the receptacle member.

In order to engage the plug connector member 10 of the present invention with the receptacle connector member 14, initially the coupling ring 24 is rotated fully counterclockwise until the rear portions of the lock pins 20 butt the rear portions 64 of the lock pin grooves 52 properly presetting the plug for engagement, as illustrated in FIG. 4. In this ready-to-mate condition of the plug, the lock ring 18 is held centrally within the groove 38 by the compression springs 43. The lock pins 20 are retracted from behind the lock ring due to the relative position of the housing 22 with respect to the lock sleeve, and the pin contacts 28 of the plug are deeply recessed from the engaging face of the lock sleeve. Mating is initiated by polarizing and axially engaging the lock sleeve to the inner shell 46 of the receptacle. Little resistance is encountered until the lock ring contacts the forward portion 51 of the shell 46. At this point, increasing the axial engaging force causes the lock ring to expand outwardly due to the angular contact of the curved outer surface of the forward portion 51 of the shell 46 and the rounded inner periphery of the lock ring.

Once the ring is expanded, it continues to follow the contour of the curved portion 51 of the receptacle shell until it snaps into the locking groove 45 as seen in FIG. 5. Continued force would cause the ring to expand over the rear edge of the lock groove, but travel is limited due to the bottoming of the forward end of the lock sleeve against the end of the filler ring 50 disposed between the inner shell 46 and the outer shell 49 of the receptacle. Removal of the engaging force at this point allows the lock ring to position the plug in its proper position for continued mating.

To continue mating of the plug and receptacle, the application of force is changed from axial to rotational torque on the coupling ring 24. As the coupling ring is rotated clockwise, the torque on the threads of the ring causes the ring to translate forwardly on lock sleeve 16. Translation of the ring causes simultaneous translation of the outer housing 22 and the insulator barrel 14 of the plug which in turn causes the lock pins to move into their lock position behind the lock ring as seen in FIG. 6.

Concurrent translation of the housing and lock pins is assured through the force provided by the coil spring 68. The spring is preloaded when assembled and provides the load necessary to keep the back edge of the coupling ring flange 74 in constant contact with the housing retaining ring 75 and the load necessary to keep the head portions 56 of the lock pins trapped in the recesses 66 in the housing. The load to the pin heads is transferred from the spring 68 through the thrust ring 70 which applies the load over the entire circumference of the flange 60 on the forward end of the housing. At this stage of mating, neither the pin contacts 28 of the plug have engaged with the socket contacts 48 of the receptacle, nor has the EMI spring 34 or the housing face seal 98 engaged, which means no force has been exerted in the direction to disengage the plug.

Figure 6:
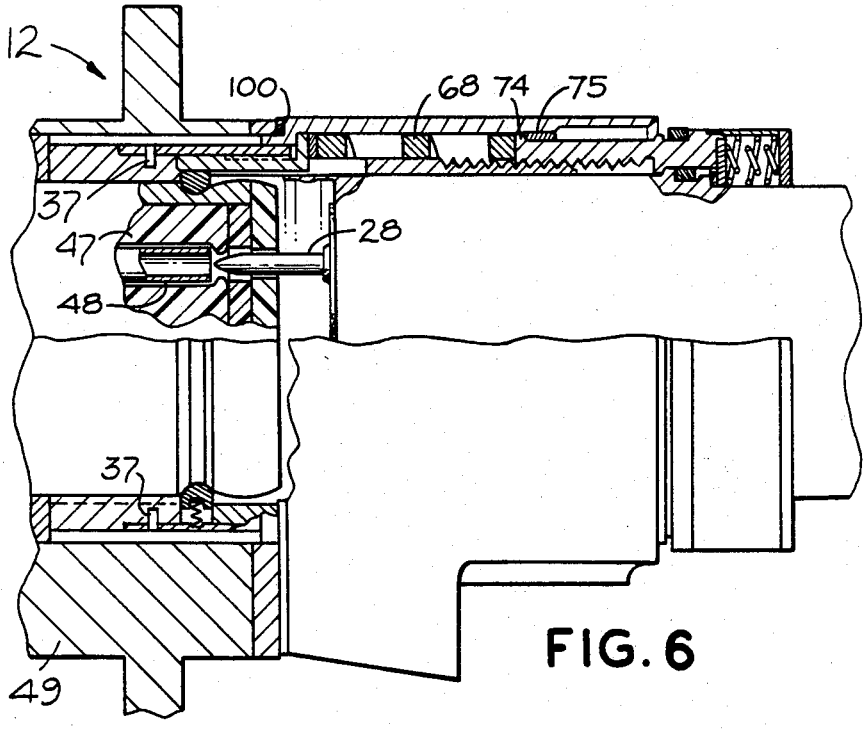
FIG. 6 is a partial longitudinal sectional view similar to FIG. 5 showing the plug and receptacle members in an intermediate mating position with the contacts therein partially engaged.

The lock pins reach their fully locked position just prior to the housing face seal 98 contacting the front face 100 of the receptacle outer shell 49 as seen in FIG. 6. Continued rotation of the coupling ring completes contact of the face seal and compresses it until the compressive load equals the preload on the spring 68. At this stage, translation of the housing 22 is essentially stopped, and the peripheral interface between the plug and receptacle is sealed.

As mating continues, the coupling ring continues to translate forward carrying the barrel 14 with it. During this period the spring 68 is being compressed, which increases the load on the peripheral seal 98, and the contacts 28 and 48, respectively, of the plug and receptacle engage, and the grounding spring 32 engages the inner shell of the receptacle. Motion of the barrel 14 is essentially stopped when the interfacial seals 76 on the insulator 26 engages the receptacle insulator face.

Figure 7:
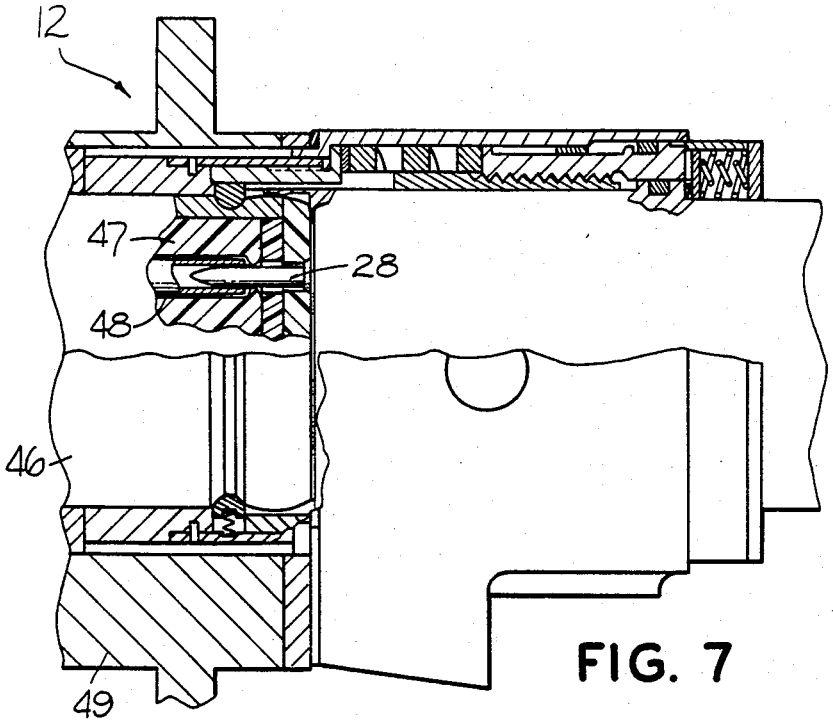
FIG. 7 is a longitudinal sectional view similar to FIG. 6 showing the connector members fully engaged and the locking mechanism completely locked.

Final partial rotation of the coupling ring causes compression of the interfacial seal springs 80 and 82, isolation of the electrical circuit from the external environment through full compression of the interfacial seals, and full engagement of the electrical contacts. Pneumatic fittings 102 may be provided on the housing 22 which inter-engage with pneumatic fittings, not shown, on the receptacle when the pin and socket contacts of the connector members are fully inter-engaged. The fully mated condition of the connector is illustrated in FIG. 7.

The plug may be separated from the receptacle either manually or automatically. Manual separation occurs simply by rotating the coupling ring fully counterclockwise and then pulling to separate the plug from the receptacle. The sequence of events occurs in exact reverse of those occurring during the manual mating cycle as described hereinabove.

Figure 8:
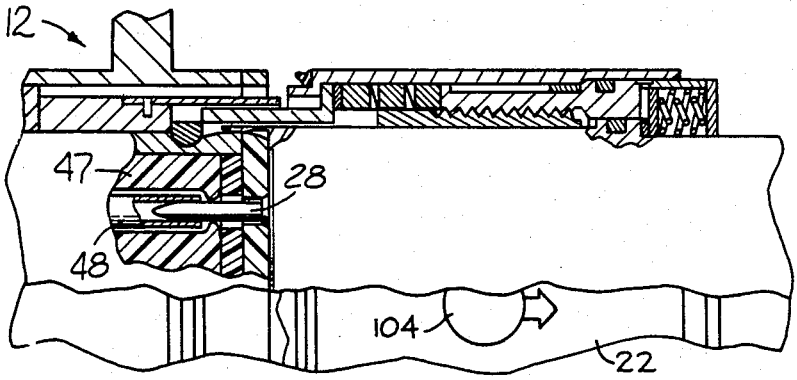
FIG. 8 is a partial longitudinal sectional view of the plug and receptacle members during automatic separation thereof.

Automatic separation may be achieved by pulling rearwardly on bosses 104 formed on the outer housing 72 of the plug. The automatic separation sequence starts with a force being applied to the bosses which is greater than the load of the spring 68, whereupon the housing will start to separate from the receptacle face, and the lock pins will start to move from behind the lock ring. Continuation of the force buildup moves the housing and lock pins rearwardly which unlocks the shells. FIG. 8 shows the relationship between the component parts just at the instant of unlocking. Once unlocking occurs, the barrel 14 is forced in the direction of separation by spring 68 which assists in complete separation.

While the lock ring 18 has been shown as being in a "contracted" position with its outer periphery spaced from the bottom of the groove 38 when the ring is unstressed, in another embodiment of the invention the ring may be fully expanded in the groove when in its unstressed condition and caused to collapse by camming action through a taper on the forward ends of the lock pins 20. Alternatively, the ring may normally be in neither a fully expanded or fully contracted position during mating, but somewhere in between which would require partial camming by the lock pins. Such an arrangement would yield minimum stress on the lock ring during mating of the plug and receptacle connector members.

It will be appreciated that in the first embodiment of the invention described herein, the lock ring is mounted on an internal surface, yet the actuating mechanism for the connector is mounted externally for convenient operation because the lock pins extend through slots in the sleeve 16 for operation by the actuating mechanism. Furthermore, the lock pins provide a very effective, positive lock between the plug and receptacle members since the pins simultaneously engage the outer periphery of the lock ring and the bottoms of the grooves 52 in the lock sleeve. With the pins in such position, it would be necessary to completely shear the lock ring, or the lock sleeve 16 or inner receptacle shell 46, or cause complete bearing load failure of the lock ring at the points of contact with the pins before unlocking of the connector members could occur.

Figure 9:
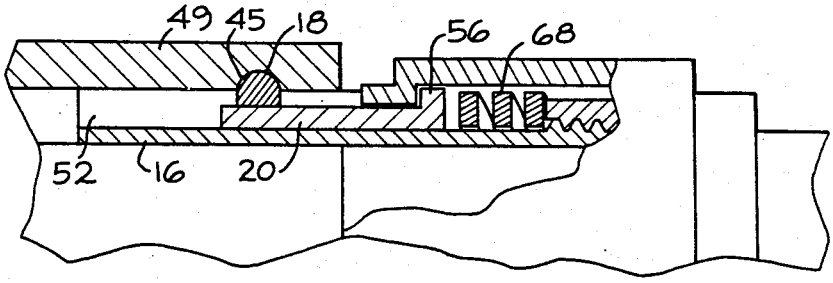
FIG. 9 is a partial longitudinal sectional view through an alternative embodiment of the plug and receptacle connector members of the present invention, shown fully engaged, wherein the lock ring is carried on an external diameter of the plug connector member rather than on an internal diameter as in the first embodiment of the invention.

Reference is now made to FIG. 9 of the drawings which shows an alternative embodiment of the invention in which the lock ring 18 is mounted around the outside of the lock sleeve 16 so that it may engage an internal annular groove 45 in the receptacle shell 49. The lock pins 20, only one being shown, are axially slidable in grooves 52 formed in the outer surface of the lock sleeve. In this arrangement, it is not necessary for the rear head portion 56 of the lock pins to extend outwardly through slots in the lock sleeve, the pins being acted upon by the housing spring 68 in a manner similar to the first embodiment of the invention. This connector would function in a manner similar to that described in connection with the first embodiment of the invention. However, because the lock ring 18 surrounds the lock sleeve, both it and the lock pins are not protected as in the first embodiment in which the lock sleeve surrounds the locking components when the plug is unmated from the receptacle.

What is claimed is:

1. An electrical connector member adapted to mate with a second connector member having a shell formed with a circular locking groove, comprising:

a housing having an insulator therein containing a plurality of electrical contacts;

a sleeve extending forwardly from said housing adapted to telescopically engage with said shell, a resilient lock ring carried by said sleeve and being located inside said sleeve;

in its unstressed condition said ring having its outer periphery spaced from a surface of said sleeve providing a gap therebetween and its inner periphery dimensioned to fit into said locking groove in locking engagement therewith;

said ring being capable of deflecting radially outwardly toward said sleeve surface when the connector member is engaged with or disengaged from said second connector member;

a plurality of axially movable lock pins slidable into said gap for locking said ring in said locking groove when said connector members are mated; and means for axially shifting said lock pins between a forward locking position in said gap and a rear release position behind said ring.

2. An electrical connector member as set forth in claim 1 including:

means positioning said ring concentrically with the center axis of said sleeve.

3. An electrical connector member as set forth in claim 2 wherein:

said positioning means comprises resilient means between said ring and said sleeve.

4. An electrical connector member as set forth in claim 1 wherein:

said lock pins are slidable in axially extending grooves formed in said sleeve.

5. An electrical connector member as set forth in claim 4 wherein:

an annular groove is formed in said sleeve intersecting said axially extending grooves; and said ring is mounted in said annular groove in said sleeve.

6. An electrical connector member as set forth in claim 5 wherein:

resilient means interposed between said sleeve and said ring for substantially centering said ring in said sleeve.

7. A plug connector member adapted to mate with a receptacle connector member having a shell formed with a circular locking groove in its outer surface, comprising:

a barrel having an insulator therein containing a plurality of electrical contacts;

a lock sleeve extending forwardly from said barrel adapted to telescopically fit over said receptacle shell;

a resilient lock ring carried by said sleeve and located on the inside of said sleeve;

in its unstressed condition said ring having its outer periphery spaced from an inner surface of said sleeve providing a gap therebetween and its inner periphery dimensioned to fit into said locking groove in locking engagement therewith;

said ring being capable of expanding outwardly toward said surface when the plug connector member is engaged with or disengaged from said receptacle connector member;

a plurality of axially movable lock pins slidable into said gap for locking said ring in said groove when said connector members are mated; and means for axially shifting said lock pins between a forward position in said gap and a rear release position behind said ring.

8. A plug connector member as set forth in claim 7 wherein:

said lock pins are slidable in axially extending grooves formed in the interior of said sleeve.

9. A plug connector member as set forth in claim 8 wherein:

an annular groove is formed in the interior of said sleeve intersecting said axially extending grooves, the bottom of said annular groove forming said sleeve inner surface; and said ring is mounted in said annular groove.

10. A plug connector member as set forth in claim 9 including:

biasing means positioning said ring concentrically with the center axis of said sleeve.

11. A plug connector member as set forth in claim 7 including:

a housing surrounding said barrel and a rear portion of said sleeve, said barrel being axially slidable within said sleeve;

said housing having an inwardly extending flange adjacent to its forward end; and said lock pins embodying rear head portions extending outwardly through axial slots in said sleeve behind said flange for limiting forward movement of said lock pins relative to said housing.

12. A plug connector member as set forth in claim 11 including:

recesses formed in the rear surface of said flange aligned with said lock pins and receiving the head portions thereof whereby the pins key the sleeves to the housing to prevent rotation therebetween.

13. A plug connector member as set forth in claim 12 including:

a thrust ring behind the head portions of said lock pins; and spring means biasing said thrust ring against said head portions.

14. A plug connector member as set forth in claim 11 including:

a coupling ring interposed between said housing and said rear portion of said sleeve;

said coupling ring being threadedly engaged with said rear portion of said sleeve; and spring means extending between said coupling ring and said head portions of said lock pins.

15. A plug connector member as set forth in claim 14 including:

force transmitting means between said coupling ring and said barrel for moving said barrel forwardly in said sleeve when said coupling ring is threaded in one direction relative to said sleeve.

16. A plug connector member as set forth in claim 7 wherein:

an annular groove of generally rectangular cross-section is formed in the interior of said sleeve;

said ring is mounted in said annular groove, the bottom of said annular groove forming said sleeve inner surface;

said ring has a generally D-shaped cross-section providing an inner rounded periphery and a cylindrical outer periphery; and the depth of said annular groove being at least as great as the radial thickness of said ring whereby said ring may be expanded fully into said annular groove.

17. A plug connector member as set forth in claim 16 wherein:

said lock pins are slidable in axially extending grooves in said lock sleeve intersecting said annular groove.

18. A plug connector member adapted to mate with a receptacle connector member having a shell formed with a circular locking groove in its outer surface comprising:

a barrel having an insulator therein containing a plurality of electrical contacts;

a lock sleeve extending forwardly from said barrel adapted to telescopically fit over said receptacle shell;

a resilient lock ring carried by said sleeve and located on the inside of said sleeve, said lock ring being engageable with said locking groove to lock said connector members together;

a plurality of axially movable lock pins slidable between the outer periphery of said ring and an inner surface of said sleeve;

axial slots extending radially through said sleeve behind said ring;

said lock pins having rear head portions extending outwardly through said slots; and means surrounding said sleeve cooperating with said head portions of said lock pins for controlling the axial position of said lock pins relative to said ring.

19. An electrical connector member adapted to mate with a second connector member having a shell formed with a circular locking groove, comprising:

a housing having an insulator therein containing a plurality of electrical contacts;

a sleeve extending forwardly from said housing adapted to telescopically engage with said shell;

a split resilient lock ring having a single gap therein, said ring being carried by said sleeve and being located inside said sleeve, said ring being engageable with said locking groove to lock said connector members together;

a plurality of circumferentially spaced, axially movable lock pins slidable between said ring and said sleeve, said pins being spaced from said gap in said lock ring; and means for axially shifting said lock pins between a forward locking position between said ring and said sleeve, and a rear release position behind said ring.

20. A plug connector member adapted to mate with a receptacle connector member having a shell formed with a circular locking groove in its outer surface, comprising:

a barrel having an insulator therein containing a plurality of electrical contacts;

a lock sleeve extending forwardly from said barrel adapted to telescopically fit over said receptacle shell;

a resilient lock ring carried by said sleeve and located on the inside of said sleeve, said lock ring being engageable with said locking groove to lock said connector members together;

a plurality of axially movable lock pins slidable between said ring and said sleeve; and means for axially shifting said lock pins between a forward position between said ring and said sleeve, and a rear release position behind said ring.

21. An electrical connector member adapted to mate with a second connector member having a shell formed with a circular locking groove in its inner surface, comprising:

a housing having an insulator therein containing a plurality of electrical contacts;

a sleeve extending forwardly from said housing adapted to telescopically engage within said shell;

a split resilient lock ring having a single gap therein, said ring being carried by said sleeve and being located outside said sleeve, said ring being engageable with said locking groove to lock said connector members together;

a plurality of circumferentially spaced, axially movable lock pins slidable between said ring and said sleeve, said pins being spaced from said gap in said lock ring; and means for axially shifting said lock pins between a forward locking position between said ring and said sleeve, and a rear release position behind said ring.

* * * * *